US011173739B2

(12) United States Patent
Ciupak

(10) Patent No.: US 11,173,739 B2
(45) Date of Patent: Nov. 16, 2021

(54) TACKY DYE SUBLIMATION COATING AND METHOD OF MAKINGS AND USING THE SAME

(71) Applicant: Neenah, Inc., Alpharetta, GA (US)

(72) Inventor: Brian Ciupak, Alpharetta, GA (US)

(73) Assignee: Neenah, Inc., Alpharetta, GA (US)

( * ) Notice: Subject to any disclaimer, the term of this patent is extended or adjusted under 35 U.S.C. 154(b) by 102 days.

(21) Appl. No.: 16/467,430

(22) PCT Filed: Nov. 21, 2017

(86) PCT No.: PCT/US2017/062803
§ 371 (c)(1),
(2) Date: Jun. 6, 2019

(87) PCT Pub. No.: WO2018/106449
PCT Pub. Date: Jun. 14, 2018

(65) Prior Publication Data

US 2020/0070558 A1 Mar. 5, 2020

Related U.S. Application Data

(60) Provisional application No. 62/430,598, filed on Dec. 6, 2016.

(51) Int. Cl.

| | |
|---|---|
| ***B41M 5/41*** | (2006.01) |
| ***B41M 5/035*** | (2006.01) |
| ***B41M 5/395*** | (2006.01) |
| ***B41M 5/42*** | (2006.01) |
| ***B41M 5/52*** | (2006.01) |

(52) U.S. Cl.
CPC ..... *B41M 5/41* (2013.01); *B41M 5/035* (2013.01); *B41M 5/395* (2013.01); *B41M 5/42* (2013.01); *B41M 5/5254* (2013.01); *B41M 2205/38* (2013.01)

(58) Field of Classification Search
CPC ..... B41M 5/41; B41M 5/42; B41M 5/5254; B41M 5/035; B41M 5/395
USPC ..... 428/32.39
See application file for complete search history.

(56) References Cited

U.S. PATENT DOCUMENTS

| | | | |
|---|---|---|---|
| 5,242,739 | A | 9/1993 | Kronzer et al. |
| 5,411,787 | A | 5/1995 | Kulkarni et al. |
| 5,501,902 | A | 3/1996 | Kronzer |
| 5,798,179 | A | 8/1998 | Kronzer |
| 7,785,764 | B2 | 8/2010 | Williams |
| 9,399,362 | B1 | 7/2016 | Cobb, III |

(Continued)

OTHER PUBLICATIONS

Divergan RS (Year: 2005).*

(Continued)

*Primary Examiner* — Betelhem Shewareged
(74) *Attorney, Agent, or Firm* — Meunier Carlin & Curfman LLC

(57) ABSTRACT

Heat transfer sheets for dye sublimation are provided, along with methods of their formation and use. The heat transfer sheet for dye sublimation may include a base sheet and a dye sublimation coating on a surface of the base sheet. The dye sublimation coating generally includes a plurality of microparticles dispersed in a polymeric binder, with the plurality of microparticles including a mixture of tack-inducing microparticles and oxide microparticles.

18 Claims, 3 Drawing Sheets

(56) References Cited

U.S. PATENT DOCUMENTS

| | | | | |
|---|---|---|---|---|
| 2004/0109958 | A1* | 6/2004 | Nigam | B41M 5/506 428/32.1 |
| 2009/0068383 | A1 | 3/2009 | Hann et al. | |
| 2012/0118490 | A1 | 5/2012 | Dolsey | |
| 2014/0134357 | A1 | 5/2014 | Kobayashi et al. | |
| 2016/0046835 | A1* | 2/2016 | Ye | B41M 5/5218 428/206 |

OTHER PUBLICATIONS

SIPERNAT 310 (Year: 2021).*
Extended European Search Report issued in application No. 17878349.4, dated Aug. 28, 2020, 11 pages.
PCT/US2017/062803, International Search Report and Written Opinion dated Jan. 29, 2018.
BASF The Chemical Company. "Project Data; Divergan RS" May 2005.

* cited by examiner

TACKY DYE SUBLIMATION COATING AND METHOD OF MAKINGS AND USING THE SAME

PRIORITY INFORMATION

The present application claims priority to U.S. Provisional Patent Application Ser. No. 62/430,598 titled "Tacky Dye Sublimation Coating and Methods of Making and Using the Same" filed on Dec. 6, 2016, the disclosure of which is incorporated by reference herein.

FIELD OF TECHNOLOGY

Heat transfer materials are generally provided that feature improved image transfer coatings and methods, particularly for use in dye sublimation onto particular substrates (e.g., polyester fabrics such as sportswear fabrics and polyester coated materials such as ceramics (e.g., mugs and coasters), metals (e.g., license plates), etc.).

BACKGROUND

In recent years, a significant industry has developed which involves the application of customer-selected designs, messages, illustrations, and the like (referred to collectively hereinafter as "images") to substrates through the use of heat transfer papers. The images are transferred from the heat transfer paper to the substrate through the application of heat and pressure, after which the heat transfer paper is removed or released, leaving the image on the substrate. Typically, a heat transfer material includes a coating on a surface of a base sheet onto which the image is printed by various methods. This image-receptive coating usually contains one or more polymeric binders, as well as other additives that enable the coating to hold the printed image and then ultimately transfer that image to the substrate.

In some applications, these decorative images are in the nature of heat transfer materials suitable for dye sublimation onto polyester fabrics and polyester coated materials. For instance, polyester fabrics, also referred to herein as sublimated fabrics, are typically heat-resistant synthetic fabrics that allow the dye sublimation colorant in the ink that forms the printed image to diffuse in the fabric fibers when subjected to heat. Typical synthetic fibers suitable for such a dye diffusion approach include polyesters, polyamides, nylons, etc.

However, dye sublimation is a particular challenge for heat transfer processes since the material can stretch and deform through the pressing process resulting in damaged or low resolution images. Recent attempts to solve this problem have included the use of various adhesives, such as liquid adhesives, applied onto the heat transfer sheet. The use of such adhesives, however, leads to longer dry times of the image and loss of resolution due to dye bleed during the printing process.

As such, a need exists for improved heat transfer materials and methods, particularly those suitable for dye sublimation transfers that temporarily adhere the transfer sheet to the substrate without negatively affecting the dry time or the dot resolution of the print.

BRIEF DESCRIPTION

Objects and advantages of the invention will be set forth in part in the following description, or may be obvious from the description, or may be learned through practice of the invention.

Heat transfer sheets are generally provided for dye sublimation, along with methods of their formation and use. In one embodiment, the heat transfer sheet for dye sublimation includes a base sheet and a dye sublimation coating on a surface of the base sheet. The dye sublimation coating generally includes a plurality of microparticles dispersed in a polymeric binder, with the plurality of microparticles including a plurality of tack-inducing microparticles. In particular embodiments, the plurality of microparticles include a plurality of tack-inducing microparticles and a plurality of oxide microparticles.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth in the specification, which makes reference to the appended FIGS., in which.

Figure 1:
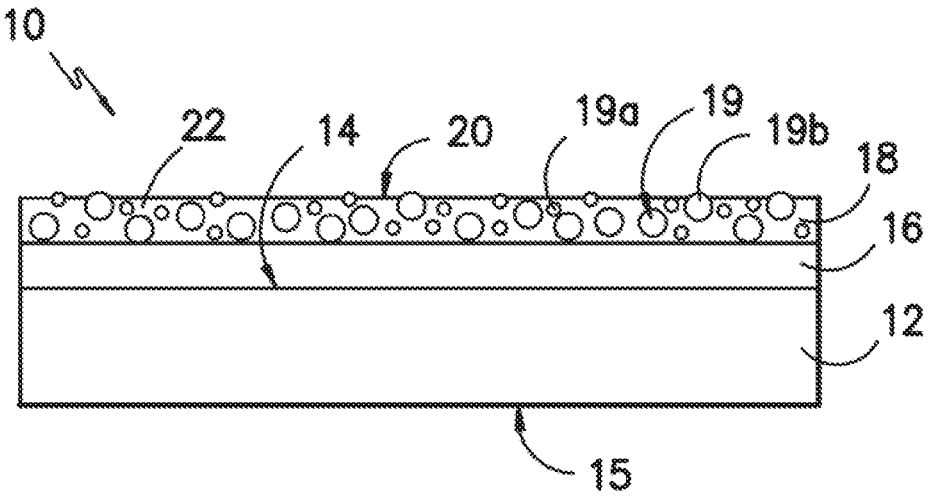
FIG. 1 shows a cross-sectional view of an exemplary heat transfer sheet for dye sublimation.

Repeat use of reference characters in the present specification and drawings is intended to represent the same or analogous features or elements of the present invention.

Definitions

As used herein, the term "printable" is meant to include enabling the placement of an image on a material (e.g., a coating) by any means, such as by direct and offset gravure printers, silk-screening, typewriters, laser printers, laser copiers, other toner-based printers and copiers, dot-matrix printers, and ink jet printers, by way of illustration. Moreover, the image composition may be any of the inks or other compositions typically used in printing processes.

The term "molecular weight" generally refers to a weight-average molecular weight unless another meaning is clear from the context or the term does not refer to a polymer. It long has been understood and accepted that the unit for molecular weight is the atomic mass unit, sometimes referred to as the "dalton." Consequently, units rarely are given in current literature. In keeping with that practice, therefore, no units are expressed herein for molecular weights.

As used herein, the term "cellulosic nonwoven web" is meant to include any web or sheet-like material which contains at least about 50 percent by weight (wt %) of cellulosic fibers. In addition to cellulosic fibers, the web may contain other natural fibers, synthetic fibers, or mixtures thereof. Cellulosic nonwoven webs may be prepared by air laying or wet laying relatively short fibers to form a web or sheet. Thus, the term includes nonwoven webs prepared from a papermaking furnish. Such furnish may include only cellulose fibers or a mixture of cellulose fibers with other natural fibers and/or synthetic fibers. The furnish also may contain additives and other materials, such as fillers, e.g., clay and titanium dioxide, surfactants, antifoaming agents, and the like, as is well known in the papermaking art.

As used herein, the term "polymer" generally includes, but is not limited to, homopolymers; copolymers, such as, for example, block, graft, random and alternating copolymers; and terpolymers; and blends and modifications thereof. Furthermore, unless otherwise specifically limited, the term "polymer" shall include all possible geometrical configurations of the material. These configurations include, but are not limited to isotactic, syndiotactic, and random symmetries.

DETAILED DESCRIPTION OF PARTICULAR EMBODIMENTS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Heat transfer materials are generally provided that feature improved image transfer coatings and methods, particularly for use on polyester substrates (e.g., polyester fabrics such as sportswear fabrics and polyester coated materials such as ceramics (e.g., coaster, mugs, etc.) and metals (e.g., license plates, etc.), and the like). In one particular embodiment, the heat transfer material includes a dye sublimation coating having a plurality of tack-inducing microparticles configured to create tack, yet leave the surface receptive to dye sublimation inks. As such, the dye sublimation coating of the heat transfer material may transfer an image thereon to a substrate (e.g., a polyester substrate) while securing the position of the transfer sheet on the substrate (through the tack-inducing microparticles) without adversely affecting the print dry time and/or resolution.

In order to produce an image on a substrate, an ink is first applied (e.g., printed) onto a dye sublimation coating of a heat transfer sheet to form an image thereon. That is, the dye sublimation coating is a printable coating. The image printed onto the dye sublimation coating is a mirror image of the image to be transferred to the final substrate. One of ordinary skill in the art would be able to produce and print such a mirror image, using any one of many commercially available software picture/design programs. Due to the vast availability of these printing processes, nearly every consumer easily can produce his or her own image to make a coated image on a substrate. Essentially, any design, character, shape, or other image that the user can print onto the image-receptive layer coating can be transferred to the substrate. The image formed on the image-receptive coating of the heat transfer sheet can be either a "positive" or "negative" image. A "positive" image is an image that is defined by the ink applied to the image-receptive coating. On the other hand, a "negative" image is an image that is defined by the area of the image-receptive coating that is free of ink.

In one particular embodiment, heat transfer sheet includes a base sheet having at least one printable coating (e.g., a dye sublimation coating) on one of its surfaces. However, in other embodiments, an intermediate coating(s) may be optionally included, such as a tie coating, a conformable coating, etc., which may be positioned between the base sheet and the printable coating.

Referring to FIG. 1, an exemplary heat transfer sheet 10 is generally shown including a base sheet 12, an optional intermediate coating 16, and a dye sublimation coating 18. Generally, the optional intermediate coating 16 and a dye sublimation coating 18 are positioned over a first surface 14 of a base sheet 12, with the optional intermediate coating 16 being positioned between the dye sublimation coating 18 and the base sheet 12 to allow the dye sublimation coating 18 to define an exterior surface 20 of the printable substrate 10.

I. Dye Sublimation Coating

The dye sublimation coating 18 can generally be applied to the first surface 14 of the base sheet 12 (i.e., either directly on the first surface 14 or on any optional intermediate coating thereon) in order to form an external, printable surface on the resulting heat transfer sheet 10. Generally, the dye sublimation coating 18 includes a plurality of microparticles 19 (e.g., a combination of microparticles, as discussed below) dispersed in a polymeric binder 22. For example, the combined weight of the microparticles can be about 5% by weight to about 80% by weight (e.g., about 10% by weight to about 75% by weight) of the dried dye sublimation coating 18.

The microparticles 19 include, in one particular embodiment, a combination of oxide microparticles 19*a* and tack-inducing microparticles 19*b*. Generally, the oxide microparticles 19*a* are present to aide in the ink adsorption and/or absorption of the coating 18 and then subsequent ink transfer to the substrate upon heating. As such, the plurality of oxide microparticles serve as an anchor to hold the printed image (e.g., formed by a ink-jet based ink and/or a toner ink) on the heat transfer sheet 10 and then as a medium to transfer the image to a substrate via dye sublimation. Conversely, the tack-inducing microparticles 19*b* aide in temporarily adhering the coating 18 to the substrate during the heat transfer process. Without wishing to be bound by theory, it is believed that the tack-inducing microparticles 19*b* create tack once heated to temporarily hold the coating 18 in place on the surface of the substrate to inhibit movement or stretching that may occur during the heat transfer to ensure a high quality dye sublimation transfer.

The tack-inducing microparticles 19*b* generally include a polymeric material, so as to avoid interacting with the ink composition applied to the coating 18. In certain embodiments, the polymeric material of the tack-inducing microparticles 19*b* may include a polystyrene material, a polyacrylic material, a polyurethane material, a polyvinylacetate material, a polyvinyl material, a polybutadiene material, a polyolefin material, a polynitrile material, a polyamide material, a polyethylene oxide, epoxy materials, etc., and mixtures thereof.

In one particular embodiment, the tack-inducing microparticles 19*b* includes a polystyrene material. Polystyrene is an aromatic polymer made from the aromatic monomer styrene. Pure polystyrene is generally a long chain hydrocarbon with every other carbon connected to a phenyl group. "Isotactic polystyrene" generally refers to an isomer of polystyrene where all of the phenyl groups are on the same side of the hydrocarbon chain. Metallocene-catalyzed polymerization of styrene can produce an ordered "syndiotactic polystyrene" with the phenyl groups on alternating sides. This syndiotactic polystyrene is highly crystalline with a melting point of about 270° C. "Atactic polystyrene" generally refers to an isomer of polystyrene where the phenyl groups are randomly distributed on both sides of the hydrocarbon chain. This random positioning prevents the polymeric chains from ever aligning with sufficient regularity to achieve any significant crystallinity. As such, atactic polystyrene has no true melting point and generally melts over a relatively large temperature range, such as between about 90° C. and about 115° C. This relatively large melting temperature range allows the thermoplastic polystyrene microparticles to resist melting and flowing at the temperatures briefly encountered during heat transfer of the image to the substrate.

The melting point of the thermoplastic polystyrene microparticles can be influenced by the molecular weight of the thermoplastic polystyrene microparticles, although the melting point can be influenced by other factors. In one embodiment, the weight average molecular weight (Mw) of the thermoplastic polystyrene polymer in the microparticles can be from about 10,000 g/mol to about 1,500,000 g/mol and the number average molecular weight.

Without wishing to be bound by any particular theory, it is believed that controlling the particle size of the thermoplastic polystyrene microparticles is particularly important in controlling the tackiness of the dye sublimation coating 18. Generally, the tack-inducing microparticles 19*b* are large enough to provide a sufficient surface to temporarily adhere the coating 18 to the surface of the substrate, but small enough so as to avoid interfering with the sharpness of the image to be transferred. In particular embodiments, the thermoplastic polystyrene microparticles have an average particle size (diameter) of about 1 micrometers (μm) to about 80 μm, such as from about 10 μm to about 55 μm (e.g., about 20 μm to about 50 μm). For example, the thermoplastic polystyrene microparticles can be polystyrene particles having an average diameter of about 20 microns (e.g., a diameter range of about 18 microns to about 22 microns) and an average molecular weight of 12,000 g/mol, such as the polystyrene particles available under the trade name DYNOSEED TS-20 (Microbeads AS, Skedsmokorset, Norway). Another example of suitable thermoplastic polystyrene microparticles can be polystyrene particles having an average diameter of about 40 microns (e.g., a diameter range of about 38 microns to about 42 microns) and an average molecular weight of 15,500 g/mol, such as the polystyrene particles available under the trade name DYNOSEED TS-40 (Microbeads AS, Skedsmokorset, Norway).

Without wishing to be bound by theory, it is believed that the oxide microparticles 19 add affinity for the inks of the printed image to the dye sublimation coating. Particularly suitable oxide microparticles 19*a* include, but are not limited to, silicon dioxide (SiO2), aluminum oxide (Al2O3), aluminum dioxide (AlO2), zinc oxide (ZnO), and combinations thereof. For example, it is believed that the metal-oxide porous microparticles (e.g., SiO2) can absorb the ink liquid (e.g., water and/or other solvents) quickly. Additionally, it is believed that oxide microparticles (e.g., SiO2) can add an available bonding site at the oxide that can ionically bond and/or interact (e.g., van der Waals forces, hydrogen bonding, etc.) with the ink binder and/or pigment molecules in the ink until transfer via dye sublimation to the substrate.

The oxide microparticles 19*a* can have an average diameter on the micrometer (micron or μm) scale, such as from about 1 μm to about 40 μm (e.g., about 1 μm to about 10 μm). Such oxide microparticles can provide a sufficiently large surface area to interact with the ink composition applied to the dye sublimation coating 18, while remaining sufficiently smooth on the exposed surface 20. Additionally, oxide microparticles that are too large can lead to grainy images formed on the dye sublimation coating 18 and/or reduce the sharpness of any image transferred therefrom.

In one embodiment, the plurality of microparticles 19 may include about 0.1% to about 50% by weight of the tack-inducing microparticles 19*b* (e.g., about 10% to about 40%), based on the total weight of the microparticles 19 in the coating 18.

The polymeric binder 22 generally serves as a medium to hold the combination of microparticles 19 in the dye sublimation coating 18 and onto the base sheet 12. Thus, the polymeric binder can provide cohesion and mechanical integrity to the dye sublimation coating 18. Generally, the polymeric binder 22 does not melt and transfer to the substrate at the transfer temperature during dye sublimation. In certain embodiments, the glass transition temperature ($T_g$) of the polymeric binder may be lower than the transfer temperature, but the polymeric binder 22 does not melt and transfer during dye sublimation due to its relatively low surface area on the surface 20 of the dye sublimation coating 18 when compared to the surface area defined by the microparticles 19 and other fillers (if present). For example, in one embodiment, the polymeric binder 22 defines about half or less of the surface area of the surface 20 of the dye sublimation coating 18, while the microparticles 19 and other fillers (if present) define about half or greater of the surface area of the surface 20 of the dye sublimation coating 18.

In general, any polymeric binder may be employed which meets the criteria specified herein. Suitable polymeric binders include, but are not limited to, polyamides, polyolefins, polyesters, polyurethanes, poly(vinyl chloride), poly(vinyl acetate), polyethylene oxide, polyacrylates, polystyrene, polyacrylic acid, epoxies, and polymethacrylic acid. Copolymers and mixtures thereof also can be used. As a practical matter, water-dispersible ethylene-acrylic acid copolymers have been found to be particularly effective polymeric binders. The polymeric binder can be present from about 1% to about 70% based on the dry weight of the dye sublimation coating 18, such as from about 1% to about 50%.

In one particular embodiment, the polymeric binder can be "polar" in nature. In one embodiment, polymers containing carboxy groups can be utilized. The presence of carboxy groups can readily increase the polarity of a polymer because of the dipole created by the oxygen atom. For example, in some embodiments, carboxylated (carboxy-containing) polyacrylates can be used as the acrylic latex binder. Also, other carboxy-containing polymers can be used, including carboxylated nitrile-butadiene copolymers, carboxylated styrene-butadiene copolymers, carboxylated ethylene-vinylacetate copolymers, and carboxylated polyurethanes. Also, in some embodiments, a combination of polar polymeric binders can be utilized within the dye sublimation coating 18.

In one embodiment, the polar polymeric binder can be an acrylic latex binder. Suitable polyacrylic latex binders can include polymethacrylates, poly(acrylic acid), poly(methacrylic acid), and copolymers of the various acrylate and methacrylate esters and the free acids; ethylene-acrylate copolymers; vinyl acetate-acrylate copolymers, and the like. Suitable acrylic latex polymers that can be utilized as the polymeric binder include those acrylic latexes sold under the trade name HYCAR® by Noveon, Inc. of Cleveland, Ohio, such as HYCAR® 26684 and HYCAR® 26084.

Other additives, such as processing agents, may also be present in the printable coating, including, but not limited to, thickeners, dispersants, emulsifiers, viscosity modifiers, humectants, pH modifiers etc. Surfactants can also be present in the printable coating to help stabilize the emulsion prior to and during application. For instance, the surfactant (s) can be present in the printable coating up to about 5%, such as from about 0.1% to about 1%, based upon the weight of the dried coating. Exemplary surfactants can include nonionic surfactants, such as a nonionic surfactant having a hydrophilic polyethylene oxide group (on average it has 9.5 ethylene oxide units) and a hydrocarbon lipophilic or hydrophobic group (e.g., 4-(1,1,3,3-tetramethylbutyl)-phenyl), such as available commercially as Triton® X-100 from Rohm & Haas Co. of Philadelphia, Pa. In one particular embodiment, a combination of at least two surfactants can be present in the printable coating.

Viscosity modifiers can be present in the printable coating. Viscosity modifiers are useful to control the rheology of the coatings in their application. For example, sodium polyacrylate (such as Paragum 265 from Para-Chem Southern, Inc., Simpsonville, S.C.) may be included in the printable coating. The viscosity modifier can be included in any amount, such as up to about 5% by weight, such as about 0.1% to about 1% by weight.

The dye sublimation coating 18 may be applied to the substrate by known coating techniques, such as by roll, blade, Meyer rod, and air-knife coating procedures. Alternatively, the dye sublimation coating 18 may be a film laminated to the base sheet. The resulting heat transfer sheet 10 then may be dried by means of, for example, steam-heated drums, air impingement, radiant heating, or some combination thereof. The dye sublimation coating 18 can, in one particular embodiment, be formed by applying a polymeric emulsion onto the tie coating on the surface of the base sheet, followed by drying.

The coat weight of the dye sublimation coating 18 generally may vary from about 1 to about 70 g/m$^2$, such as from about 3 to about 50 g/m$^2$. In particular embodiments, the coat weight of the dye sublimation coating 18 may vary from about 5 to about 40 g/m$^2$, such as from about 7 to about 25 g/m$^2$.

II. Base Sheet

A base sheet 12 that acts as a backing or support layer for the heat transfer sheet 10. The base sheet 12 is flexible, and is typically a polymeric film or a cellulosic nonwoven web (e.g., a paper sheet). In addition to flexibility, the base sheet 12 also provides strength for handling, coating, sheeting, other operations associated with the manufacture thereof. The basis weight of the base sheet 12 generally may vary, such as from about 10 to about 150 g/m$^2$. Suitable base sheets 12 include, but are not limited to, cellulosic nonwoven webs and polymeric films. A number of suitable base sheets 12 are disclosed in U.S. Pat. Nos. 5,242,739; 5,501,902; and 5,798,179; the entirety of which are incorporated herein by reference.

Desirably, the base sheet 12 comprises paper. A number of different types of paper are suitable including, but not limited to, common litho label paper, bond paper, and latex saturated papers. In some embodiments, the base sheet 12 will be a latex-impregnated paper such as described, for example, in U.S. Pat. No. 5,798,179. The base sheet 12 is readily prepared by methods that are well known to those having ordinary skill in the art.

III. Dye Sublimation Process

Figure 2:
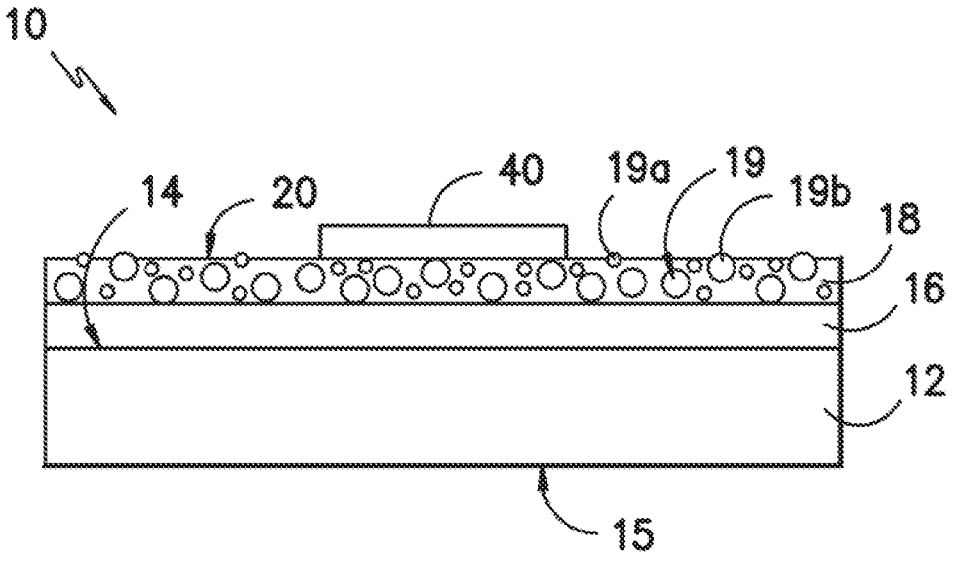
FIG. 2 shows a cross-sectional view of an exemplary heat transfer sheet with an image thereon for heat transfer via dye sublimation.

In FIG. 2, an image is defined by the dye sublimatable ink 40 on the dye sublimation coating 18, with the remainder of the surface area of the dye sublimation coating 18 being substantially free of ink 40. As stated, the image defined by ink 40 is a mirror image of the desired image to be applied to the final substrate. In certain embodiments, the dye sublimatable ink 40 may be applied onto the dye sublimation coating 18 via a printing process, such as ink jet printing, toner printing, flexographic printing, gravure printing, lithography, etc. In most embodiments, the dye sublimatable ink 40 is applied onto the dye sublimation coating 18 at temperatures below about 100° C. so as to prevent activating the ink.

The dye sublimatable ink 40 typically includes a dye sublimation colorant within an ink medium (e.g., a wax component). Dye sublimation colorants (also referred to as a sublimation ink solid) are generally solid materials that change to gas at the transfer temperature, usually at temperatures of about 175° C. to about 205° C. Such dye sublimation colorants have a high affinity for polyester at these activation temperatures and gassification bonding generally takes place to permanently attach the dye sublimation colorant to the polyester material. Virtually any material may be used as an ink medium which can be applied via the printing process, and which will withstand the sublimation temperatures, as is described herein.

Figure 3:
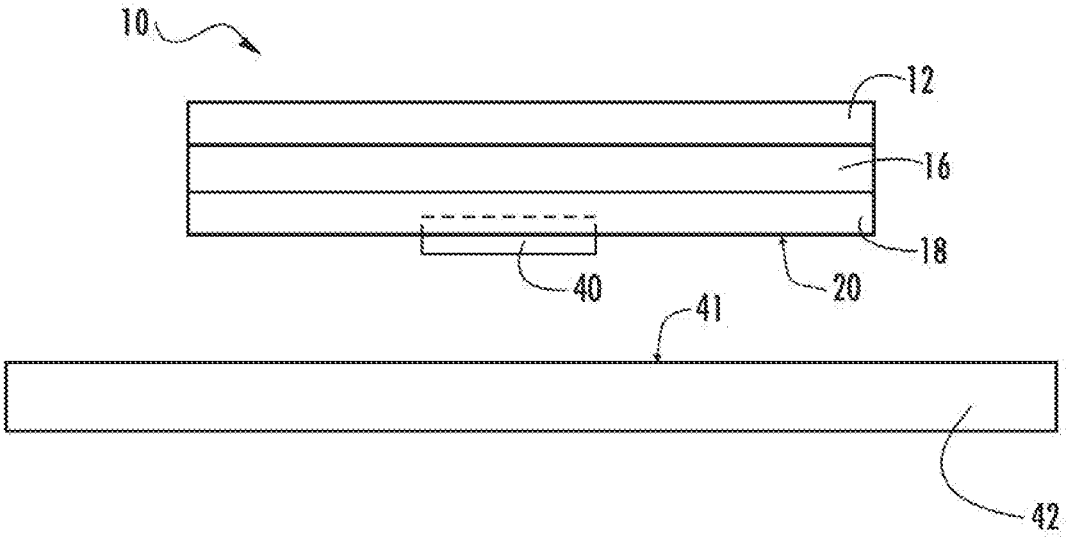
FIGS. 3-5 sequentially show an exemplary method of transferring the image of FIG. 2 onto a substrate via dye sublimation.
Figure 4:
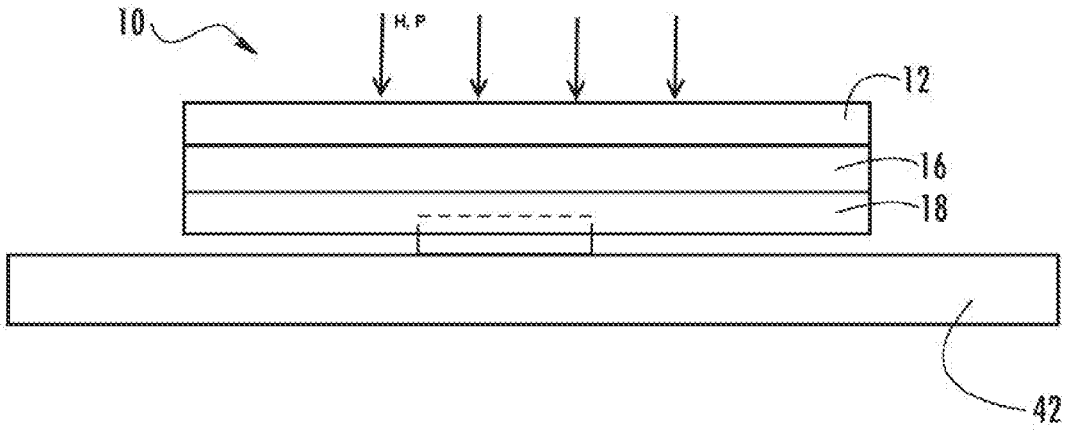

Referring to FIG. 3, the heat transfer sheet 10 is positioned adjacent to the surface 41 of the substrate 42 with the dye sublimation coating 18 facing the surface 41 such that the image 41 is adjacent thereto. Referring to FIG. 4, heat (H) and pressure (P) are then applied to the exposed base sheet 12 of the heat transfer sheet 10 adjacent to the substrate 40. The heat (H) and pressure (P) can be applied to the heat transfer sheet 10 via a heat press, an iron (e.g., a conventional hand iron), etc. The heat (H) and pressure (P) can be applied to the heat transfer sheet 10 for a time sufficient to cause the dye sublimation of the image 40 to the substrate 42. Temperatures at the transfer can be from about 150° C. or greater, such as from about 150° C. to about 225° C. (e.g., about 190° C. to about 205° C.), and can be applied for a period of a few seconds to a few minutes (e.g., from about 5 seconds to about 5 minutes).

Figure 5:
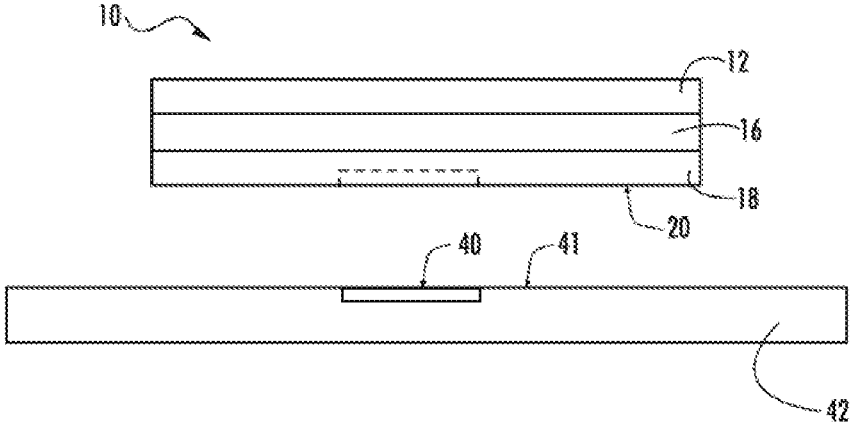

Finally, the heat transfer sheet 10 can be removed from the substrate 42 such that the image 40 is transferred without substantially transferring any of the dye sublimation coating 18, as shown in FIG. 5 and without impeding the quality of the image transferred.

EXAMPLE

The following materials were used in these Examples:

Dynoseeds TS-40 (Microbeads AS, Skedsmokorset, Norway) is a plurality of polystyrene particles having an average diameter of about 40 microns and an average molecular weight of 15,500 g/mol;

SY-350 (available under the name Sylysia® from Fuji Silysia Chemical) is a plurality of micronized synthetic amorphous silica-gel particles having an average particle size of about 3.9 μm;

Hycar 26706 (Noveon, Inc., Cleveland, Ohio) is an acrylic latex polymer;

ECOSURF™ EH is a series of nonionic surfactants available from Dow Chemical Company; and Paragum 265 (Para-Chem Southern, Inc., Simpsonville, S.C.) is sodium polyacrylate useful as a thickener.

A dye sublimation mixture was formed as a precursor to be applied to a base sheet for forming a dye sublimation coating thereon. Two dispersions were formed: a 16.5% SY350 Pigment Dispersion and a Polystyrene Particle Dispersion.

Dispersion 1 (16.5% SY350 Pigment Dispersion)

| INGREDIENTS | % | parts | dry | wet |
|---|---|---|---|---|
| WATER | 0.0 | 0.0 | 0.0 | 835.0 |
| SY350 | 100.0 | 100.0 | 165.0 | 165.0 |
| totals | 16.5 | | 165 | 1000 |

Dispersion 2 (Polystyrene Particle Dispersion)

| INGREDIENTS | % | parts | dry | wet |
|---|---|---|---|---|
| DYNOSEEDS TS40 | 100.0 | 98.0 | 588.4 | 588.4 |
| ECOSURF SA-9 | 100.0 | 2.0 | 11.8 | 11.8 |
| Water | 0.0 | 0.0 | 0.0 | 399.8 |
| totals | 60.0 | | 600 | 1000 |

These dispersions were then mixed with together with Hycar 2607, Ecosurf SA-9, and Paragum 265 according to the coating formulation below:

Coating Formula

| INGREDIENTS | % | parts | dry | |
|---|---|---|---|---|
| Dispersion 1 | 16.5 | 110.3 | 109.7 | 37.3 |
| Dispersion 2 | 60.0 | 75.2 | 74.8 | 25.4 |
| HYCAR 26706 | 49.5 | 100.0 | 99.4 | 33.8 |
| ECOSURF SA-9 | 100.0 | 10.1 | 10.0 | 3.4 |
| PARAGUM 265 | 13.6 | 0.0 | 0.0 | 0.0 |
| totals | 29.4 | | 294 | |

The coating formulation was applied to a base paper (24 lb. super smooth base paper available under the trade name Classic Crest® from Neenah Paper, Inc., Alpharetta, Ga.) in an amount of 2.5 pounds per ream (144 yards$^2$), which is about 9.4 gsm, using a Myer rod. The coating was applied as an aqueous dispersion/mixture and then dried to remove the water.

These and other modifications and variations to the present invention may be practiced by those of ordinary skill in the art, without departing from the spirit and scope of the present invention, which is more particularly set forth in the appended claims. In addition, it should be understood the aspects of the various embodiments may be interchanged both in whole or in part. Furthermore, those of ordinary skill in the art will appreciate that the foregoing description is by way of example only, and is not intended to limit the invention so further described in the appended claims.

What is claimed is:

1. A heat transfer sheet for dye sublimation, comprising:

a base sheet having a first surface and a second surface; and a dye sublimation coating on the first surface of the base sheet, wherein the dye sublimation coating comprises a plurality of microparticles dispersed in a polymeric binder, and wherein the plurality of microparticles comprises a mixture of tack-inducing microparticles and oxide microparticles, wherein the tack-inducing microparticles are capable of creating tack once heated to adhere the dye sublimation coating in place on a substrate.

2. The heat transfer sheet of claim 1, wherein the oxide microparticles comprise silicon oxide, aluminum oxide, or a mixture thereof.

3. The heat transfer sheet of claim 1, wherein the plurality of tack-inducing microparticles comprises a polystyrene material, a polyacrylic material, a polyurethane material, a polyvinylacetate material, a polyvinyl material, a polybutadiene material, a polyolefin material, a polynitrile material, a polyamide material, a polyethylene oxide, epoxy materials, and mixtures thereof.

4. The heat transfer sheet of claim 1, wherein the plurality of microparticles comprises about 0.1% to about 50% by weight of the tack-inducing microparticles.

5. The heat transfer sheet of claim 1, wherein the plurality of microparticles comprises about 10% to about 40% by weight of the tack-inducing microparticles.

6. The heat transfer sheet of claim 1, wherein the plurality of tack-inducing microparticles have an average particle size of about 5 μm to about 80 μm.

7. The heat transfer sheet of claim 6, wherein the plurality of tack-inducing microparticles have an average particle size of about 30 μm to about 50 μm.

8. The heat transfer sheet of claim 1, wherein the oxide microparticles comprise silica microparticles having an average particle size of about 1 μm to about 10 μm.

9. The heat transfer sheet of claim 8, wherein the plurality of silica microparticles have an average particle size of about 1 μm to about 6 μm.

10. The heat transfer sheet of claim 8, wherein the plurality of microparticles consist essentially of the tack-inducing microparticles and the silica microparticles.

11. The heat transfer sheet of claim 1, wherein the base sheet comprises a cellulosic nonwoven web.

12. The heat transfer sheet of claim 1, wherein the base sheet comprises a polymeric film.

13. The heat transfer sheet of claim 1, wherein the plurality of tack-inducing microparticles comprises polystyrene.

14. The heat transfer sheet of claim 1, wherein the dye sublimation coating is directly on the first surface of the base sheet.

15. The heat transfer sheet of claim 1, wherein an intermediate layer is between the dye sublimation coating and the first surface of the base sheet.

16. A method for transferring an image to a substrate, the method comprising:

providing a heat transfer sheet for dye sublimation according to claim 1 comprising a base sheet having a first surface and a second surface; and a dye sublimation coating on the first surface of the base sheet, wherein the dye sublimation coating comprises a plurality of microparticles dispersed in a polymeric binder, and wherein the plurality of microparticles comprises a mixture of tack-inducing microparticles and oxide microparticles, and wherein the tack-inducing microparticles are capable of creating tack once heated to adhere the dye sublimation coating in place on a substrate;

applying an image onto the dye sublimation coating of the heat transfer sheet;

thereafter, positioning the dye sublimation coating adjacent to the substrate;

thereafter, applying heat and pressure to the heat transfer sheet such that the image is transferred to the substrate via dye sublimation; and removing the heat transfer sheet from the substrate while leaving the image thereon.

17. The heat transfer sheet of claim 1, wherein the plurality of tack-inducing microparticles are derived from a thermoplastic polymer.

18. The heat transfer sheet of claim 1, wherein the plurality of tack-inducing microparticles are characterized in that they inhibit interaction between a dye sublimation ink and the tack-inducing microparticles.

* * * * *